US012313258B2

(12) United States Patent
Xiang et al.

(10) Patent No.: US 12,313,258 B2
(45) Date of Patent: May 27, 2025

(54) ELASTIC RESET DEVICE

(71) Applicant: Zhejiang Weiming Environment Protection Co., Ltd., Wenzhou (CN)

(72) Inventors: Guangming Xiang, Wenzhou (CN); Rong Li, Wenzhou (CN); Yuan Ren, Wenzhou (CN)

(73) Assignee: Zhejiang Weiming Environment Protection Co., Ltd., Wenzhou (CN)

( * ) Notice: Subject to any disclaimer, the term of this patent is extended or adjusted under 35 U.S.C. 154(b) by 715 days.

(21) Appl. No.: 17/719,527

(22) Filed: Apr. 13, 2022

(65) Prior Publication Data

US 2022/0333771 A1 Oct. 20, 2022

(30) Foreign Application Priority Data

Apr. 15, 2021 (CN) ..... 202110406300.X

(51) Int. Cl.
*F23H 17/08* (2006.01)

(52) U.S. Cl.
CPC ..... *F23H 17/08* (2013.01); *F23H 2700/001* (2013.01)

(58) Field of Classification Search
CPC ..... F23H 17/08; F23H 17/00
See application file for complete search history.

(56) References Cited

U.S. PATENT DOCUMENTS

| | | | | |
|---|---|---|---|---|
| 1,982,797 | A * | 12/1934 | Denny | F23H 11/00 110/270 |
| 5,188,528 | A * | 2/1993 | Rast | F23M 5/04 110/332 |
| 5,413,715 | A * | 5/1995 | Basic, Sr. | F23H 1/02 210/523 |
| 6,220,190 | B1 * | 4/2001 | Dumbaugh | F23J 1/06 110/328 |
| 2008/0276843 | A1 * | 11/2008 | Sund | F23H 9/04 110/234 |

* cited by examiner

*Primary Examiner* — David J Laux
(74) *Attorney, Agent, or Firm* — Morse, Barnes-Brown & Pendleton, P.C.; Martin Z. Zhang

(57) ABSTRACT

An elastic reset device arranged in the middle of a grate plate is disclosed, which includes reset blocks, springs, sleeves and a guide plate. The reset blocks comprise a left reset block and a right reset block, the upper ends of the left and right reset blocks are partially overlapped, a folding angle α is provided at the overlapping portion and is not less than 45 degrees, and a ceramic fiber blanket is filled at the folding angle.

6 Claims, 4 Drawing Sheets

A–A

C–C

ELASTIC RESET DEVICE

CROSS REFERENCE TO RELATED APPLICATIONS

This application claims the priority of Chinese Patent Application No. 202110406300.X, entitled "ELASTIC RESET DEVICE" filed with the Chinese Patent National Intellectual Property Administration on Apr. 15, 2021, which is incorporated herein by reference in its entirety.

TECHNICAL FIELD

The present disclosure relates to the field of boilers, and in particular to an elastic reset device.

BACKGROUND ART

As the width of a grate gradually increases, the amount of thermal expansion of the grate gradually increases. In order to avoid a fault in the grate due to thermal expansion, it is ensured that the ventilation cross section of the grate is constant, therefore, in the prior art, a device having an elastic reset function is additionally provided in the grate plates. However, the ash slag on the grate is easier to enter the device having the elastic reset function during operation, thereby affecting the elastic reset function, and elastic members of the elastic reset device is easily disabled because the temperature of the region is high.

SUMMARY

The object of the present disclosure is to provide a device having an elastic reset function. The device can ensure that the ventilation cross section of the grate is constant, avoid failure of the elastic reset function due to entry of ash slag on the grate into the device, and has the features of convenient installation and maintenance. The specific technical solutions are as follows:

An elastic reset device, arranged in a middle of a grate plate, including reset blocks, springs, sleeves and a guide plate, wherein the reset blocks comprise a left reset block and a right reset block, an upper end of the left reset block and an upper end of the right reset block are arranged to overlap each other in a portion at which a folding angle α not less than 45 degrees is provided, and a ceramic fiber blanket is filled at the folding angle.

In some embodiments, the springs and the sleeves can be uniformly distributed inside the elastic reset device, each of the sleeves can include an outer sleeve and an inner sleeve which can be fixedly connected to the left reset block and the right reset block respectively. One of the springs can be fitted between the outer sleeve and the inner sleeve, and both ends of the one of the springs can press against the left reset block and the right reset block such that the left reset block and the right reset block are always in close contact with the grate plate.

In some embodiments, lower ends of the left reset block and the right reset block can be provided with longitudinal waist shape holes.

In some embodiments, a guide plate can be provided in a middle between the left reset block and the right reset block, the guide plate can sleeve the outer sleeve, and a bottom end of the guide plate can be supported on a support base.

In some embodiments, the support base may be provided with transverse waist shape holes.

In some embodiments, each of the longitudinal waist shape holes and each of the transverse waist shape holes are aligned with each other, and are connected to each other via a bolt and a nut as well as a spring washer.

The present disclosure has the following advantages:

First, in order to avoid failure of the elastic reset device due to entry of ash slag therein during the operation of the grate plate, the upper ends of the left and right reset blocks are arranged to overlap each other in a portion at which a folding angle α not less than 45 degrees is provided, and the ceramic fiber blanket is filled therebetween. The guide plate is arranged in the middle between the left reset block and the right reset block, and even if a small amount of ash slag enters the elastic reset device, the springs will not be collided to affect their operations.

Second, in order to make the elastic reset device meet the expansion requirement, the lower ends of the reset blocks are provided with longitudinal waist shape holes, and the support base is provided with transverse waist shape holes, so as to freely expand in respective directions.

Third, in order to facilitate the installation and maintenance, the elastic reset device is provided with bolts and nuts as well as spring washers for being connected to the support base.

Fourth, in order to prevent the elastic reset device from failure due to high temperature, all materials employ heat resistant stainless steel.

Figure 1:
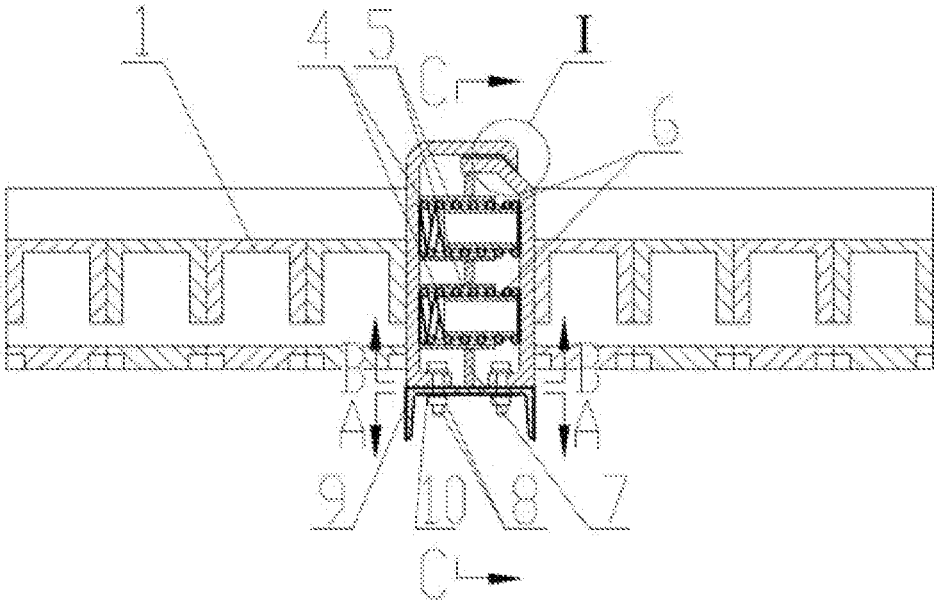
FIG. 1 is a view of the overall structure of the present disclosure.

Reference numerals in the figures: 1 grate plate, 2 left reset block, 3 right reset block, 4 spring, 5 outer sleeve, 6 inner sleeve, 7 guide plate, 8 bolts and nuts, 9 support base, 10 spring washer, 11 ceramic fiber blanket, 12 longitudinal waist shape hole, 13 transverse waist shape hole.

DETAILED DESCRIPTION OF THE EMBODIMENTS

The present disclosure is further described below in conjunction with the accompanying drawings.

Figure 2:
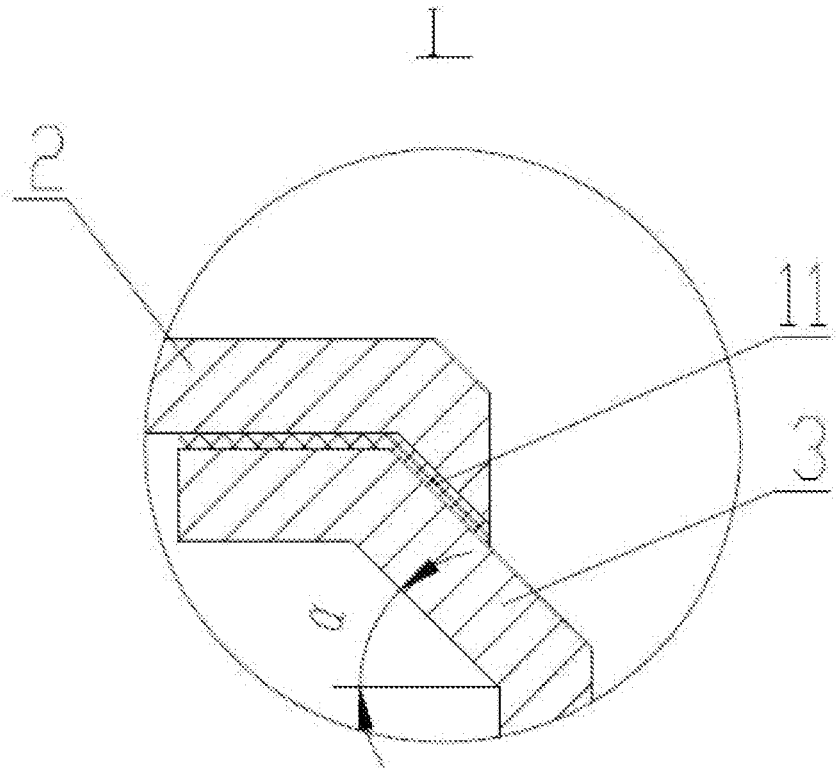
FIG. 2 is an enlarged view of portion I in FIG. 1.
Figure 3:
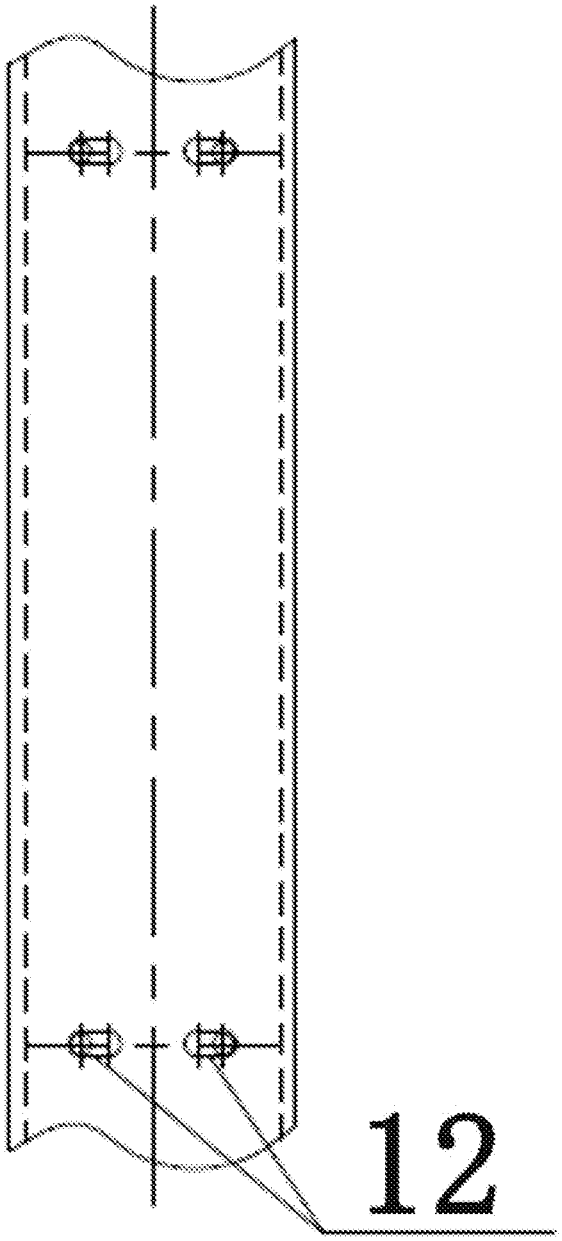
FIG. 3, FIG. 4 and FIG. 5 are schematic diagrams of holes in section A-A, section B-B, and section C-C of FIG. 1, respectively.
Figure 4:
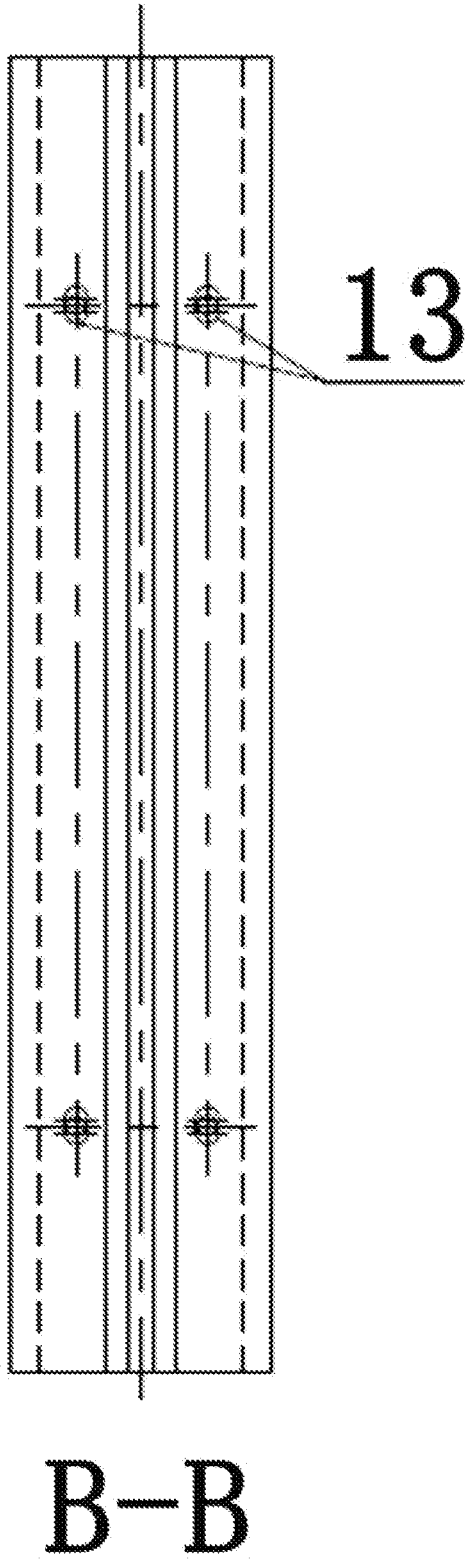
Figure 5:
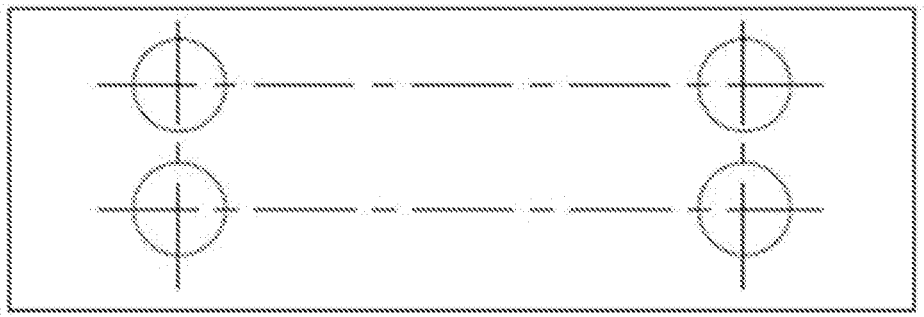

As shown in FIG. 1, the elastic reset device of the present disclosure is arranged in the middle of the grate plate 1, and includes reset blocks, springs 4, sleeves and a guide plate 7. The reset blocks comprise a left reset block 2 and a right reset block 3. As shown in FIG. 2, upper ends of the left reset block and the right reset block are arranged to overlap each other in a portion, a folding angle α is provided at the overlapping portion, and the folding angle α is not less than 45 degrees, and the ceramic fiber blanket 11 is filled at the folding angle. The springs 4 and the sleeves are uniformly distributed inside the elastic reset device, and each sleeve comprises an outer sleeve 5 and an inner sleeve 6 which are respectively fixedly connected to the left and right reset blocks. The spring 4 is fitted between the outer sleeve 5 and the inner sleeve 6, and both ends of the spring 4 press against the left and right reset blocks such that the left and right reset blocks are always in close contact with the grate plate 1. As shown in FIG. 3, the guide plate 7 is disposed in the middle between the left reset block 2 and the right reset block 3, the guide plate 7 sleeves the outer sleeve 5, and a bottom end of the guide plate 7 is supported on the support base 9. As shown in FIGS. 4 and 5, lower ends of the left and right reset blocks are provided with longitudinal waist shape holes 12, the support base 9 is provided with transverse waist shape holes 13, and each of the longitudinal waist shape holes 12 and each of the transverse waist shape holes 13 are aligned with each other and are connected to each other via a bolt and a nut 8 as well as a spring washer 10.

The operation process of the elastic reset device of the present disclosure is as follows:

During operation of the grate plate, the grate plate in close contact with the elastic reset device is heated to generate thermal expansion, and the left reset block 2 and the right reset block 3 of the elastic reset device are pushed centrally to drive the outer sleeve 5 and the inner sleeve 6 to move and press the spring 4 at the same time. Since the lower ends of the reset blocks are provided with the longitudinal waist shape holes 12, the support base 9 is provided with the transverse waist shape holes 13, and the two are connected via the bolts and nuts 8 and the spring washers 10, thereby meeting the expansion requirement in respective directions. When the grate is cooled and thus contracted, the forces applied to the reset blocks are reduced, and under the action of the springs 4, the reset blocks are in close contact with the grate plate, thereby eliminating a possible gap between the reset blocks and the grate plate, ensuring the ventilation cross section of the grate plate is constant.

What is claimed is:

1. An elastic reset device, arranged in a middle of a grate plate, comprising reset blocks, springs, sleeves and a guide plate, wherein the reset blocks comprise a left reset block and a right reset block, an upper end of the left reset block and an upper end of the right reset block are arranged to overlap each other in a portion at which a folding angle $\alpha$ not less than 45 degree is provided, and a ceramic fiber blanket is filled at the folding angle.

2. The elastic reset device as claimed in claim 1, wherein the springs and the sleeves are uniformly distributed inside the elastic reset device, each of the sleeves comprises an outer sleeve and an inner sleeve which are fixedly connected to the left reset block and the right reset block respectively, one of the springs is fitted between the outer sleeve and the inner sleeve, and both ends of the one of the springs press against the left reset block and the right reset block, respectively, such that the left reset block and the right reset block are always in close contact with the grate plate.

3. The elastic reset device as claimed in claim 2, wherein a guide plate is provided in a middle between the left reset block and the right reset block, the guide plate sleeves the outer sleeve, and a bottom end of the guide plate is supported on a support base.

4. The elastic reset device as claimed in claim 3, wherein the support base is provided with transverse waist shape holes.

5. The elastic reset device as claimed in claim 4, wherein each of the transverse waist shape holes and each of the transverse waist shape holes are aligned with each other, and are connected to each other via a bolt and a nut as well as a spring washer.

6. The elastic reset device as claimed in claim 1, wherein lower ends of the left reset block and the right reset block are provided with longitudinal waist shape holes.

* * * * *